US007378374B2

(12) United States Patent
Watanabe et al.

(10) Patent No.: US 7,378,374 B2
(45) Date of Patent: May 27, 2008

(54) THERMALLY SENSITIVE RECORDING MEDIUM

(75) Inventors: Masayuki Watanabe, Tokyo (JP); Kaoru Hamada, Tokyo (JP); Junpei Natsui, Tokyo (JP); Yuji Tsuzuki, Tokyo (JP); Takashi Date, Tokyo (JP)

(73) Assignee: Nippon Paper Industries Co., Ltd., Kita-ku, Tokyo (JP)

( * ) Notice: Subject to any disclaimer, the term of this patent is extended or adjusted under 35 U.S.C. 154(b) by 359 days.

(21) Appl. No.: 10/526,247

(22) PCT Filed: Aug. 28, 2003

(86) PCT No.: PCT/JP03/10960

§ 371 (c)(1),
(2), (4) Date: Feb. 25, 2005

(87) PCT Pub. No.: WO2004/020210

PCT Pub. Date: Mar. 11, 2004

(65) Prior Publication Data

US 2006/0007765 A1 Jan. 12, 2006

(30) Foreign Application Priority Data

Aug. 30, 2002 (JP) ..... 2002-252279

(51) Int. Cl.
*B41M 5/40* (2006.01)

(52) U.S. Cl. ..... 503/226; 503/200

(58) Field of Classification Search ..... None
See application file for complete search history.

(56) References Cited

U.S. PATENT DOCUMENTS 5,128,310 A * 7/1992 Mitsuo et al. ..... 503/226

* cited by examiner

*Primary Examiner*—Bruce H. Hess
(74) *Attorney, Agent, or Firm*—Flynn, Theil, Boutell & Tanis, P.C.

(57) ABSTRACT

A thermally sensitive recording medium containing a thermally sensitive recording medium providing an undercoating layer containing a pigment and a binder as main components and a thermally sensitive recording layer containing a colorless or pale colored basic leuco dye and a color developing agent, which reacts with said basic leuco dye, as main components on a substrate, wherein the undercoating layer contains carboxymethyl cellulose having an etherification degree of from 0.55 to 0.75 and hydroxyethyl cellulose from the view point of high effectiveness.

7 Claims, No Drawings

THERMALLY SENSITIVE RECORDING MEDIUM

FIELD OF THE INVENTION

The present invention relates to a thermally sensitive recording medium which utilizes a coloring reaction of a basic colorless dye with an organic color developing agent.

BACKGROUND OF THE INVENTION

In general, a thermally sensitive recording medium is prepared by the following process. That is, after a colorless or pale colored basic leuco dye and an organic color developing agent are respectively ground to fine particles, these particles are mixed together with additives such as a binder, a filler, a sensitizer and a slipping agent or others to obtain a coating, then the obtained coating is coated on a substrate such as a paper, a synthetic paper, a film or a plastic. The thermally sensitive recording medium develops color by an instant chemical reaction caused by heating with a thermal head, a hot stamp, a thermal pen or a laser beam. Usually, a thermally sensitive recording medium is broadly applied for a facsimile use, a terminal printer of a computer, an automatic bending machine for tickets and a recorder of a measuring instrument. Recently, along with the diversification or high qualification of a recording apparatus, high speed printing and high speed image formation are becoming possible, accordingly, more excellent quality is required to the recording sensitivity of thermally sensitive recording medium. Further, along with the diversification of usage, a recorded image of high quality is required at a whole range from lower density to higher density.

As a method to satisfy these requirement, the technique to improve the smoothness of the surface of thermally sensitive recording layer using a super calender or others is ordinary carried out, however, a sufficient high quality image can not be obtained. It is well known that the coating uniformity of the undercoating layer is important for the formation of a high quality image, for example, the improvement of the smoothness of the undercoating layer by using a super calendar is well known. Further, in Patent Document 1, for the purpose of providing a thermally sensitive recording medium having an excellent reproducibility of dot, the technique to accumulate the first intermediate layer and the second intermediate layer between a substrate and a thermally sensitive layer by order, and to adjust the OKEN smoothness of the first intermediate layer to 700 seconds or more and the density of the second intermediate layer to 0.1 or less is disclosed.

In the meanwhile, for the purpose of obtaining a highly sensitive thermally sensitive recording sheet, for example in Patent Document 2, there is a disclosure that two or more intermediate layers are provided between a substrate and a color developing layer and the uppermost layer contains from 0.3 wt % to 3 wt % of carboxymethyl cellulose and/or hydroxyethyl cellulose to pigment.

Patent Document 1: JPA 2000-108518 publication

Patent Document 2: JPA H4-348989 publication

However, by the method using a super calender, the porous property of the under coating layer is hurt and the adiabatic property is lost by calender pressure and the sensitivity is deteriorated. The method of accumulating plural intermediate layers is not advantageous from the view point of industrial production because the process becomes complicated. Therefore, the object of the present invention is to provide a thermally sensitive recording medium which does not cause the above mentioned problems, has excellent recording sensitivity and can obtain a recorded image of a high quality.

DISCLOSURE OF THE INVENTION

This object can be obtained by a thermally sensitive recording medium comprising, a thermally sensitive recording medium having an undercoating layer containing a pigment and a binder as main components and a thermally sensitive recording layer containing a colorless or pale colored basic leuco dye and a color developing agent, which reacts with said basic leuco dye, as main components on a substrate, wherein said undercoating layer contains carboxymethyl cellulose whose etherification degree is from 0.55 to 0.75.

PREFERRED EMBODIMENT OF THE INVENTION

The embodiment of the present invention will be illustrated more in detail.

The undercoating layer of the present invention contains a pigment and a binder as main components and further contains carboxymethyl cellulose. The reason why the excellent effect is obtained in the present invention is not obvious, however, it is conjectured as follows.

As one reason to deteriorate the quality of image, a lower concentration of solids and a higher water amount in a coating for an undercoating layer in a thermally sensitive recording layer can be mentioned. Compared with that, the solids concentration of a coating of a coated layer of ordinary coating paper for printing is from 60 to 70%, the solids concentration of a coating of a thermally sensitive recording layer is set up to the level of less than 40% for the purpose of obtaining a good quality and dispersability of the coating, which depends on the kind of pigment and binder to be used, and when it is coated on a substrate such as paper, water in the coating can easily penetrate into the substrate and causes uneven surfaces on the coated layer. Further, the binder migrates to a lower part with the water and the distribution of the binder and orientation of the pigment in the coated layer become unequal. When a thermally sensitive layer is provided on said undercoating layer and an image is recorded on said surface, thermal energy is not transferred uniformly and dots become irregular, consequently, it is conjectured that the sensitivity and the quality of image deteriorate. On the contrary, carboxymethyl cellulose used in the present invention is conjectured to have a function of enhancing the water-holding ability of the coating, can control the penetration of water into the substrate, and can contribute to the formation of a uniform coated layer without an uneven thickness.

Further, the inventors of the present invention have found that the etherification degree of the carboxymethyl cellulose is the important factor to influence the water-holding ability of a coating. The term "etherification degree" indicates the average value of the substituted degree of the hydroxyl group, which the cellulose has, by the carboxymethyl group. The lower the etherification degree the carboxymethyl cellulose has, the more hydroxyl groups the carboxymethyl cellulose contains, and the more easily to bond with a water molecule by a hydrogen bond, therefore, the tendency to improve the water-holding ability of the coating is observed, however, since the hydrogen bond between the carboxymethyl cellulose molecules becomes strong (crystallinity is advanced) and the carboxymethyl cellulose becomes difficult to dissolve in water, preparation of the coating becomes difficult and productivity deteriorates. In the meanwhile, when the etherification degree is high, although the water-holding ability of the coating is not good, the solubility in water becomes good and the handling becomes easy. In the present invention, from the view point of balance of these two properties, the desirable etherification degree is from 0.55 to 0.75 and more desirably from 0.55 to 0.65.

Furthermore, the higher polymerization degree of the carboxymethyl cellulose causes an improvement in water-holding ability because a molecule of a higher polymerization degree can take in more water. However, since the viscosity of the aqueous solution becomes high, when the polymerization degree is too high, it becomes impossible to coat or to prepare a coating. Therefore, the desirable polymerization degree of the carboxymethyl cellulose is 2000 or less and, concerning water-holding ability, more desirably is from 500 to 1500.

Concerning the amount of carboxymethyl cellulose, when the amount of carboxymethyl cellulose is too small, it is impossible to obtain a sufficient water-holding ability, and the desirable blending amount of carboxymethyl cellulose is from 0.1 weight parts to 5 weight parts to 100 weight parts of pigment, more desirably from 0.3 weight parts to 2 weight parts to 100 weight parts of pigment.

In the present invention, it is effective to contain hydroxyethyl cellulose and carboxymethyl cellulose. It is considered that hydroxyethyl cellulose has an effect of improving the fluidity of a coating, and is conjectured to provide an undercoating layer which contributes to the uniformity of the recorded image.

It is considered that hydroxyethyl cellulose has a function of improving the water-holding ability of a coating and the desirable etherification degree of it is from 0.8 to 2.0 and, more desirably, from 1.0 to 1.5. The reason why is almost the same as that of carboxymethyl cellulose and when the etherification degree of it is lower, the water-holding ability is improved, however, its solubility in water has a tendency to deteriorate. On the contrary, when the etherification degree of it becomes higher, the water-holding ability deteriorates, however, handling becomes easier because the solubility in water is improved. While, the term "etherification degree of hydroxylethyl cellulose" indicates the average value of the substituted degree of the hydroxyl groups of cellulose by ethyleneoxide.

Regarding the polymerization degree of hydroxyethyl cellulose, the inventors of the present invention have found that the viscosity of aqueous solution, which relates with the polymerization degree, is important. Specifically, the B viscosity of a 2% aqueous solution is 300 mPa·s or less. When the viscosity of aqueous solution becomes too high, the preparation of a coating becomes hard. When the viscosity of aqueous solution becomes too low, generally, the polymerization degree becomes low too, therefore, it is necessary to increase the using amount for the purpose to obtain sufficient water-holding ability, and the lower limit is considered to be around 5 mPa·s.

In the present invention, the function of carboxymethyl cellulose and hydroxyethyl cellulose are considered to be basically the same. Compared with carboxymethyl cellulose, hydroxyethyl cellulose has several tens of absorbing force to clay, which is a pigment, (referring document: T. S. Young and E. Fu., Tappi J. 74(4):199 (1991)), a coating forms a structural body and, therefore, is superior in water-holding ability (dynamic water-holding ability) right under a blade when coated by a blade coater. Especially, in the case of a vent coating, which scrapes a coating by using a blade laying down, or a beveling coating, which scrapes a coating by using a blade turning up, pressure is loaded to the contacted part and the coating is pressed strongly against the paper, therefore, water easily dehydrates from the coating and the coating becomes solid. Consequently, scum of the coating accumulates on the edge of the blade and becomes a cause of forming a striped streak (defect on a coated surface) on the coated surface. On the contrary, in the case of a coating of the present invention, whose dynamic water-holding ability is high, the penetration of water into the paper right under the blade becomes difficult and the solidification of the coating is prevented and, therefore, is excellent in coating application of a bent coating or a beveling coating and can prevent the generation of defects such as streaking.

In the meanwhile, compared with hydroxyethyl cellulose, since carboxymethyl cellulose is inferior in absorption to clay, it exists mainly in water. Therefore, it is excellent in water-holding ability before a blade (static water-holding ability). Therefore, by using carboxymethyl cellulose together with hydroxyethyl cellulose, a good coated surface can be obtained and the coating aptitude of coating is considered to be improved.

Further, a higher concentration of coating is desirable because the amount of coating can be decreased, however, it links to the solidification of the coating. The function of the carboxymethyl cellulose and hydroxyethyl cellulose is effective in the case when the concentration of the coating is high and is more easily solidified.

The amount of hydroxyethyl cellulose is desirably 0.5 weight parts to 5.0 weight parts in total amount with carboxymethyl cellulose to 100 weight parts of pigment and, desirably, 0.5 weight parts to 3.5 weight parts in total amount with carboxymethyl cellulose to 100 weight parts of pigment. When the amount of hydroxyethyl cellulose is too small, the water-holding ability and fluidity are not improved sufficiently, on the contrary, when the amount of hydroxyethyl cellulose is too high, the viscosity becomes too high and the coating becomes hard. The desirable amount of hydroxyethyl cellulose is 0.3 weight part to 3.5 weight parts to 100 weight parts of pigment.

Further, in the present invention, in the case when carboxymethyl cellulose and hydroxyethyl cellulose are used together, it is effective to use carboxymethyl cellulose whose polymerization degree is 1000 or less. When these two are used together, the viscosity of the coating becomes too high and the operation efficiency has a tendency to deteriorate and the operation efficiency can be improved by making the polymerization degree of the carboxymethyl cellulose smaller.

In the undercoating layer of the present invention, a water-soluble polymer such as starch, polyvinylalcohol, methyl cellulose, styrene or maleic anhydride, or an emulsion of a synthetic resin such as styrene-butadiene copolymer or acrylic acid copolymer can be contained as a binder.

At the preparation of this undercoating layer, the coating amount is from about 1 to 15 g/m$^2$ and can be prepared by applying a coating on a suitable substrate such as paper, recycled paper, plastic film or synthetic paper by means of a normal coating machine. As a coating method, well known methods such as the air knife method, blade method, gravure method or roll coater method can be used, however, it is desirable to form an undercoating layer by means of a blade coating method, in particular, by means of a vent blade coating method, because by this method, a highly concentrated coating is possible, the coating does not penetrate into a substrate and a uniform layer can be formed.

As a pigment to be contained in the undercoating layer, (calcined) koalin, calcium carbonate, aluminium oxide, titanium oxide, magnesium carbonate, amorphous silica, aluminium silicate, magnesium silicate or calcium silicate can be mentioned. Especially, calcined kaolin having an oil absorption (based on the method prescribed in JIS K5101) of from 80 cc/100 g to 120 cc/100 g is most desirable because an excellent thermally sensitive recording medium having a good balance in color developing sensitivity and quality of image can be obtained. By using said calcined kaolin, sufficient adiabatic effect is provided and the sensitivity is improved, further, it is considered that since a binder is not absorbed by a large amount of pigment, a uniform coated layer is formed so that an excellent image can be obtained. In the meanwhile, compared with spherical calcium carbonate, the use of calcined kaolin is inferior in fluidity of a coating because the shape of it is flat, further, an OH (hydroxyl) group of silanol is not existing on the surface because it is calcined and its bonding force with water is weakened and the water-holding ability of the coating easily deteriorates. However, in the present invention, by the function of carboxymethyl cellulose and hydroxyethyl cellulose, the coating suitability of calcined kaolin is improved.

Additionally, to the undercoating layer, a dispersing agent, waxes, a thickener, a surface active agent, UV absorbing agent, an antioxidant, a water repellent agent or an oil repellent agent can be added when need arises.

The thermally sensitive recording layer to be formed on the undercoating layer is formed according to the conventional well known method.

As the colorless or pale colored basic leuco dye to be used in the thermally sensitive recording medium of the present invention, all publicly known dyes in the field of conventional pressure sensitive or thermally sensitive recording paper can be used and is not specifically limited, however, triphenylmethane compounds, fluorane compounds, fluorene compounds or divinyl compounds can be desirably used. Specific examples of typical colorless or pale colored basic leuco dye are shown below. These colorless or pale colored basic leuco dyes can be used alone or can be used together.

<Triphenyl Methane Leuco Dyes>

3,3-bis(p-dimethylaminophenyl)-6-dimethylaminophthalide (also known as Crystal Violet Lactone)

3,3-bis(p-dimethylaminophenyl)phthalide (also known as Malachite Green Lactone)<

<Fluorane Leuco Dyes>

3-diethylamino-6-methylfluorane
3-diethylamino-6-methyl-7-anilinofluorane
3-diethylamino-6-methyl-7-(o,p-dimethylanilino)fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-fluoroanilino)fluorane
3-n-dipentylamino-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-cyclohexyl amino-6-chlorofluorane <Divinyl Leuco Dyes>

3,3-bis-[2-(p-dimethylaminophenyl)-2-(p-methoxyphenyl)-ethenyl]-4,5,6,7-tetrabromophthalide 3,3-bis-[2-(p-dimethylaminophenyl)-2-(p-methoxyphenyl)-ethenyl]-4,5,6,7-tetrachlorophthalide 3,3-bis-[1,1-bis(4-pyrrolidinophenyl)ethylene-2-yl]-4,5,6,7-tetrabromophthalide 3,3-bis-[1-(4-methoxyphenyl)-1-(4-pyrrolidinophenyl)ethylene-2-yl]-4,5,6,7-tetrachlorophthalide <Others>

3-(4-diethylamino-2-ethoxyphenyl)-3-(1-ethyl-2-methylindol-3-yl)-4-azaphthalide 3-(4-diethylamino-2-ethoxyphenyl)-3-(1-octyl-2-methylindol-3-yl)-4-azaphthalide 3-(4-cyclohexylethylamino-2-methoxyphenyl)-3-(1-ethyl-2-methylindol-3-yl)-4-azaphthalide 3,3-bis(1-ethyl-2-methylindol-3-yl)phthalide 3,6-bis(diethylamino)fluorane-γ-(3'-nitro)anilinolactam 3,6-bis(diethylamino)fluorane-γ-(4'-nitro)anilinolactam 1,1-bis-[2',2',2",2"-tetrakis-(p-dimethylaminophenyl)-ethenyl]-2,2-dinitrilethane 1,1-bis-[2',2',2",2"-tetrakis-(p-dimethylaminophenyl)-ethenyl]-2,2-diacetylethane bis-[2,2,2',2'-tetrakis-(p-dimethylaminophenyl)-ethenyl]-methylmalonic acid dimethyl ester.

As a color developing agent used in the thermally sensitive recording media of the present invention, conventional publicly known color developing agent which develops the color of colorless or pale colored basic leuco dye are suitable. As specific examples of the color developing agent are bisphenol A, 4-hydroxybenzoic acid esters, 4-hydroxyphthalic acid diesters, phthalic acid monoesters, bis-(hydroxyphenyl)sulfides, 4-hydroxyphenyl-arylsulfones, 4-hydroxyphenylarylsulfonates, 1,3-di[2-(hydroxyphenyl)-2-propyl]benzenes, 4-hydroxybenzoyl-oxybenzoates or bisphenolsulfones which are mentioned in Japanese Patent Laid-open Publication 3-207688 or in Japanese Patent Laid-open Publication 5-24366.

Further, as to the conventional thermally sensitive recording medium, in the present invention, publicly known sensitizers can be used.

As the specific example of the sensitizer, fatty acid amides such as stearic acid amide or palmitic acid amide,
ethylenebisamide,
montan acid wax,
polyethylene wax,
1,2-di-(3-methylphenoxy)ethane,
p-benzylbiphenyl,
β-benzyloxynaphthalene,
4-biphenyl-p-tolylether,
m-tarphenyl,
1,2-diphenoxyethane,
dibenzyl benzoate,
di-(p-chlorobenzyl)benzoate,
di-(p-methylbenzyl)benzoate,
dibenzylterephthalate,
benzyl p-benzyloxybenzoate,
di-p-tolylcarbonate,
phenyl-α-naphthylcarbonate,
1,4-diethoxynaphthalene,
phenyl 1-hydroxy-2-naphthoate,
o-xylene-bis-(phenylether),
4-(m-methylphenoxymethyl)biphenyl can be mentioned,
4,4'-ethylene-bis-dibenzylbenzoate,
dibenzoyloxymethane,
1,2-di(3-methylphenoxy)ethylene,
Bis[2-(4-methoxy-phenoxy)ethyl]ether and
p-phenyltoluenesulfonate can be mentioned, however, not intending to be restricted to them. These sensitizers can be used alone or can be used together.

As an image stabilizer, which displays an oil repellent effect to the recorded image,
4,4'-buthylidenebis(6-t-butyl-3-methylphenol),
2,2'-di-t-butyl-5,5'-dimethyl-4,4'-sulphonyldiphenyl,
1,1,3-tris(2-methyl-4-hydroxy-5-cyclohexylphenyl)butane or 1,1,3-tris(2-methyl-4-hydroxy-5-t-butylphenyl)butane can be added.

Furthermore, a parting agent such as fatty acid metallic salt, a slipping agent such as wax, UV absorbing agent such as bezophenone or triazol, a water repellent agent such as glyoxal, a dispersing agent, a defoamer, an oxidant and a fluorescent agent can be used.

The kinds and amount of basic leuco dye, color developing agent and other components which are used in the thermally sensitive recording medium of the present invention, are decided according to the required properties and recording suitability and not restricted, however, ordinarily, 0.5 to 10 parts of color developing agent and 0.5 to 10 parts of filler to 1 part of basic leuco dye is used.

The subjected thermally sensitive recording medium can be obtained by applying the coating composed of the above mentioned composition on a substrate such as paper, recycled paper, synthetic paper, film, plastic film or plastic foam film. A composite sheet which is prepared by combining these substrates can be used as a substrate.

Basic leuco dyes, color developing agents and other materials to be added by necessity are pulverized by a ball mill, an attriter or a sand grinder, or by means of an adequate emulsifying apparatus, until they are pulverized to several microns size, then add an acrylic emulsion, colloidal silica and various additives according to the object and prepare a coating. The means for coating is not restricted and publicly known conventional methods can be used, and specifically, for example, an off machine coater with various coaters such as an air knife coater, rod blade coater, vent blade coater, bevel blade coater and curtain coater or an on machine coater can be voluntarily chosen and used. Among these, regarding a blade coating method, the coating amount can be controlled by a blade and is desirable because the productive efficiency is high, and it is considered that the larger the contacting area with the paper is, the more uniform the coated surface becomes, the use of the vent blade coating method is especially desirable in the present invention. The coating amount of the thermally sensitive layer is not restricted, and ordinary is in the range from 2 to 12 g/m$^2$ by dry weight.

Still further, the thermally sensitive recording medium of the present invention can provide a polymeric overcoating layer on the thermally sensitive recording layer aiming to improve the preservability, a polymeric undercoating layer containing a filler under the thermally sensitive recording layer aiming to improve the color developing sensitivity and a bag coating layer on the opposite side of the substrate to which the thermally sensitive recording is provided, for the purpose to correct the curling of the sheet. Yet further, various publicly known techniques in the field of the thermally sensitive recording medium can be added voluntarily, for example, to carry out a smoothness treatment such as super calender treatment after the coating process of each layer.

EXAMPLE

Preparation of Thermally Sensitive Recording Medium, Example 1 and Comparative Example 1-4

The thermally sensitive recording medium of the present invention will be illustrated more according to the Examples and the Comparative Examples. In the Examples and the Comparative Examples, "parts" and "%" indicates "weight parts" and "weight %". Each solution, dispersion and a coating is prepared as follows.

Example 1

The compound consisting of the blending ratio mentioned below is stirred and dispersed and a coating for the undercoating layer is prepared. While, in all Examples and Comparative Examples, the concentration of the coatings are fixed to around 36%.

| U solution (coating for undercoating layer) | |
|---|---|
| Calcined kaolin (product of Engelhard, commodity name is Ansilex 90, <oil absorbing amount is 90 cc/100 g> | 100 parts |
| Stylene•butadiene copolymer latex (solid part 48%) | 40 parts |
| Polyvinyl alcohol 10% aqueous solution | 30 parts |
| Carboxymethyl cellulose 2% solution (polymerization degree; 500-600, etherification degree; 0.55-0.65) | 25 parts |
| Water | 146 parts |

After applying the coating for the undercoating layer to one surface of the substrate (paper of 100 g/m$^2$), the object is dried and the undercoating layer of 10.0 g/m$^2$ coating amount is obtained.

A dispersion of a color developing agent (A solution) of the following blending ratio and dispersion of basic leuco dye (B solution) are respectively ground in a wet condition by a sand grinder so as the average particle size becomes 1 micron.

| A solution (dispersion of color developing agent) | |
|---|---|
| 4-hydroxy-4'-isopropoxydiphenylsulfone | 6.0 parts |
| Polyvinyl alcohol 10% aqueous solution | 18.8 parts |
| Water | 11.2 parts |
| B solution (dispersion of basic leuco dye) | |
| 3-diethylamino-6-methyl-7-anilinofluorane (OBD-2) | 2.0 parts |
| Polyvinyl alcohol 10% aqueous solution | 4.6 parts |
| Water | 2.6 parts |

Then the dispersions are blended in the following ratio and a coating for a recording layer is obtained.

| Coating for recording layer | |
|---|---|
| A solution (dispersion of color developing agent) | 36.0 parts |
| B solution (dispersion of basic leuco dye) | 9.2 parts |
| Kaolin clay (50% dispersion) | 12.0 parts |

The coating for the recording layer is applied on the undercoating layer of the paper on which an undercoating layer is formed so that the coating amount is 6.0 g/m$^2$, dried and the sheet treated by a super calender so that the smoothness is 500 to 600 seconds, thus, a thermally sensitive recording medium is obtained.

Example 2

A thermally sensitive recording medium is prepared in the same way as Example 1 except for changing the polymerization degree of the carboxymethyl cellulose contained in the U solution (coating for the undercoating layer) to 600-800 and the etherification degree to 0.65-0.75.

Example 3

A thermally sensitive recording medium is prepared in the same way as Example 1 except for changing the polymerization degree of the carboxymethyl cellulose contained in the U solution (coating for the undercoating layer) to 1000-1500 and etherification degree to 0.55-0.65.

Example 4

A thermally sensitive recording medium is prepared in the same way as Example 2 except for adding 25 parts of a 2% aqueous solution of hydroxyethyl cellulose having an etherification degree of 1.21 and viscosity of 12 mPa·s to the U solution (coating for the undercoating layer) and changing the parts of water in the U solution to 122 parts.

Example 5

A thermally sensitive recording medium is prepared in the same way as Example 4 except for changing the etherification degree of the hydroxyethyl cellulose contained in the U solution (coating for the undercoating layer) to 1.32 and the viscosity of a 2% aqueous solution of that to 100 mPa·s.

Example 6

A thermally sensitive recording medium is prepared in the same way as Example 4 except for changing the etherification degree of the hydroxyethyl cellulose contained in the U solution (coating for undercoating layer) to 1.3 and the viscosity of a 2% aqueous solution of that to 1500 mPa·s.

Comparative Example 1

A thermally sensitive recording medium is prepared in the same way as Example 1 except for not adding carboxymethyl cellulose to the U solution (coating for undercoating layer).

Comparative Example 2

A thermally sensitive recording medium is prepared in the same way as Example 1 except for changing the polymerization degree of the carboxymethyl cellulose contained in the U solution (coating for the undercoating layer) to 400-500 and the etherification degree to 1.3-1.6.

Comparative Example 3

A thermally sensitive recording medium is prepared in the same way as Example 1 except for changing the polymerization degree of the carboxymethyl cellulose contained in the U solution (coating for the undercoating layer) to 500-800 and the etherification degree to 1.3-1.6.

<Evaluation of Recording Sensitivity>

The printing test is made on the prepared thermally sensitive recording media using TH-PMD, a product of Okura Electric Co., Ltd. (printing tester for thermally sensitive recording paper, a thermal head of Kyocera Co., Ltd. is equipped), by 0.27 mJ/dot impressive energy. The recording density of the printed part is measured by means of a Macbeth Densitometer (RD-914, amber filter used).

<Evaluation of Printed Image>

All over solid part is evaluated by visual inspection.

○: white come off part is not observed

Δ: white come off parts are observed

X: many white come off parts are observed

<Evaluation of Coating>

Dynamic water-holding capacity (AA dehydration amount) of the prepared coatings for the undercoating layer is measured by an AA-GWR water retention meter, which is the product of Kaltec Scientific Co., Ltd. A smaller value of this test indicates a higher water-holding capacity and also indicates that the water-holding ability right under the blade becomes high and a defect such as streak is not so easily generated. The paper used for measurement is a paper whose grammage is 100 g/m$^2$.

TABLE 1

| | carboxymethyl cellulose | | hydroxyethyl cellulose | |
|---|---|---|---|---|
| | Etherification degree | Polymerization degree | Etherification degree | Polymerization degree |
| Example 1 | 0.55-0.65 | 500-600 | — | — |
| Example 2 | 0.65-0.75 | 600-800 | — | — |
| Example 3 | 0.55-0.65 | 1000-1500 | — | — |
| Example 4 | 0.65-0.75 | 600-800 | 1.21 | 12 |
| Example 5 | 0.65-0.75 | 600-800 | 1.32 | 100 |
| Example 6 | 0.65-0.75 | 600-800 | 1.3 | 1500 |
| Com. Ex. 1 | — | — | — | — |
| Com. Ex. 2 | 1.3-1.6 | 400-500 | — | — |
| Com. Ex. 3 | 1.3-1.6 | 500-800 | — | — |

Com. Ex. Comparative Example

TABLE 2

| | concentration of recorded part | AA dehydration amount (g/m$^2$) | quality of image |
|---|---|---|---|
| Example 1 | 1.32 | 129 | ○ |
| Example 2 | 1.33 | 118 | ○ |
| Example 3 | 1.33 | 93 | ○ |
| Example 4 | 1.34 | 95 | ○ |
| Example 5 | 1.35 | 88 | ○ |
| Example 6 | 1.35 | 63 | ○ |
| Com. Ex. 1 | 1.31 | 208 | X |
| Com. Ex. 2 | 1.32 | 172 | Δ |
| Com. Ex. 3 | 1.32 | 155 | Δ |

INDUSTRIAL APPLICABILITY

By the present invention, a thermally sensitive recording medium which is superior in vent blade or bevel blade aptitude of undercoating layer, having a high recording sensitivity and excellent quality of image can be obtained.

The invention claimed is:

1. A thermally sensitive recording medium comprising an undercoating layer containing a pigment and a binder as main components and a thermally sensitive recording layer containing a colorless or pale colored basic leuco dye and a color developing agent, which reacts with said basic leuco dye, as main components on a substrate, wherein said undercoating layer contains carboxymethyl cellulose having an etherification degree of from 0.55 to 0.75 and hydroxyethyl cellulose in a total amount of 0.5-5.0 parts per 100 parts of pigment.

2. The thermally sensitive recording medium of claim 1, wherein the pigment is calcined kaolin having an oil absorption, as determined by JIS K5101, of from 80 ml/100 g to 120 ml/100 g.

3. The thermally sensitive recording medium of claim 1, wherein the B viscosity of a 2% aqueous solution of hydroxyethyl cellulose is 300 mPa·s or less.

4. The thermally sensitive recording medium of claim 1, wherein the binder consists of at least one member selected from the group consisting of starch, polyvinyl alcohol, methyl cellulose, styrene, maleic anhydride, an emulsion of a styrene-butadiene copolymer and an emulsion of an acrylic acid copolymer.

5. The thermally sensitive recording medium of claim 4, wherein the carboxymethyl cellulose and the hydroxyethyl cellulose are contained in a total amount of 0.5-5 parts per 100 parts of pigment.

6. The thermally sensitive recording medium of claim 1, wherein the hydroxyethyl cellulose has an etherification degree of from 0.8-2.0.

7. The thermally sensitive recording medium of claim 1, wherein the B viscosity of a 2% aqueous solution of the hydroxyethyl cellulose is from 5-300 mPa·s.

* * * * *